US010365611B2

(12) United States Patent
Rochat et al.

(10) Patent No.: US 10,365,611 B2
(45) Date of Patent: Jul. 30, 2019

(54) MOON PHASE INDICATOR MECHANISM

(71) Applicant: Blancpain SA, Le Brassus (CH)

(72) Inventors: Marco Rochat, Le Brassus (CH); Clement Barberat, La Chaux-de-Fonds (CH)

(73) Assignee: Blancpain SA, Le Brassus (CH)

( * ) Notice: Subject to any disclaimer, the term of this patent is extended or adjusted under 35 U.S.C. 154(b) by 0 days.

(21) Appl. No.: 15/540,604

(22) PCT Filed: Dec. 14, 2015

(86) PCT No.: PCT/EP2015/079564
§ 371 (c)(1),
(2) Date: Jun. 29, 2017

(87) PCT Pub. No.: WO2016/107730
PCT Pub. Date: Jul. 7, 2016

(65) Prior Publication Data

US 2017/0364031 A1 Dec. 21, 2017

(30) Foreign Application Priority Data

Dec. 31, 2014 (EP) ..... 14200745

(51) Int. Cl.
*G04B 19/26* (2006.01)
*G04B 19/04* (2006.01)
*G04B 45/04* (2006.01)

(52) U.S. Cl.
CPC ..... *G04B 19/268* (2013.01); *G04B 19/26* (2013.01); *G04B 19/262* (2013.01);
(Continued)

(58) Field of Classification Search
None
See application file for complete search history.

(56) References Cited

U.S. PATENT DOCUMENTS 4,684,260 A * 8/1987 Jackle ..... G04B 19/268 368/16
4,853,908 A * 8/1989 Bourquin ..... G04B 19/266 368/19

(Continued)

FOREIGN PATENT DOCUMENTS

CH 657740 A * 9/1986 ..... G04B 19/268
CH 703 447 B1 1/2012

(Continued)

OTHER PUBLICATIONS

Chopard, Remy, et al., English Translation of CH 657740, originally published Sep. 30, 1986, retrieved from Espacenet on Dec. 21, 2018, full document (Year: 1986).*

(Continued)

*Primary Examiner* — Daniel P Wicklund
(74) *Attorney, Agent, or Firm* — Oblon, McClelland, Maier & Neustadt, L.L.P.

(57) ABSTRACT

A moon phase indicator mechanism, for a timepiece provided with a movement and a dial, the moon phase indicator mechanism including at least one moon disc, and at least one moon phase train driven by the timepiece movement, the moon phase train meshing with a moon phase wheel which carries the moon disc at least indirectly and in a fixed manner, the moon phase wheel taking the form of a toothed ring in order to move the moon disc with the moon phase train about an axis A.

17 Claims, 4 Drawing Sheets

(52) U.S. Cl.
CPC ..... *G04B 19/042* (2013.01); *G04B 19/046* (2013.01); *G04B 45/046* (2013.01)

(56) References Cited

U.S. PATENT DOCUMENTS

| | | | | | |
|---|---|---|---|---|---|
| 5,345,429 | A * | 9/1994 | Rebeaud | G04B 19/26 368/15 |
| 5,508,979 | A * | 4/1996 | Eisenegger | G04B 19/26 368/15 |
| 6,847,589 | B2 * | 1/2005 | Wilmouth | G04B 19/268 368/16 |
| 2007/0223316 | A1 * | 9/2007 | Born | G04B 19/26 368/15 |
| 2015/0063077 | A1 * | 3/2015 | Karsch | G04B 19/268 368/16 |
| 2017/0336760 | A1 * | 11/2017 | Candaux | G04B 19/283 |

FOREIGN PATENT DOCUMENTS

| | | | | |
|---|---|---|---|---|
| DE | 202011004056 | U1 * | 1/2012 | G04B 19/02 |
| JP | 63234189 | A * | 9/1988 | G04B 19/268 |
| JP | 2009-216547 | A | 9/2009 | |
| WO | 02/46846 | A2 | 6/2002 | |
| WO | 2004/013708 | A2 | 2/2004 | |

OTHER PUBLICATIONS

Sato, Mamoru, English Translation of JP63234189, originally published Sep. 29, 1988, retrieved from Espacenet on Dec. 21, 2018, full document (Year: 1988).*

Oechslin, Ludwig, English Translation of WO 2004013708, originally published Feb. 12, 2004, retrieved from Espacenet on Dec. 21, 2018, full document (Year: 2004).*

Yilmazer, Ziya, English Translation of DE 202011004056, originally published Mar. 22, 2012, retrieved from Espacenet on Dec. 21, 2018, full document (Year: 2012).*

International Search Report dated Apr. 11, 2016, in PCT/EP2015/079564, filed Dec. 14, 2015.

Augereau, "Les Rouages Lunaires", Jahrbuch der Deutschen Gesellschaft fur Chronometrie E.V., vol. 45, No. 1, Oct. 18-19, 1994, p. 49-58, XP 000494981, with English Summary.

* cited by examiner

MOON PHASE INDICATOR MECHANISM

FIELD OF THE INVENTION

The invention relates to a moon phase indicator mechanism for timepieces.

BACKGROUND OF THE INVENTION

Moon phase indicator devices have existed for a long time and include a moon disc on which two yellow circles symbolising the moon are drawn on a dark-coloured background, while a substantially semi-circular aperture in the dial comprises a base separated into two concave parts, all of which is well known to those skilled in the art. During the rotation of this type of moon disc underneath the aperture, the various moon phases are displayed. Conventionally, the moon phase mechanism is formed of a gear train driven by an hour wheel and by the disc on which the two representations of the moon are affixed.

For example, it is known from EP Patent No 2009517 to propose a watch equipped with such a device.

One drawback of this type of watch is that the indicator mechanism is actuated once per day, which does not provide a realistic display of the moon phases. Further, a conventional mechanism is difficult to incorporate in a movement and can result in an overload of components in the movement and thereby increase the thickness of the watch case which harms the aesthetics thereof. Finally, this type of mechanism requires the moon phase indicator to be actuated at a determined time, generally 7 pm, to avoid an accumulation of functions at midnight causing too great a loss in the amplitude of the sprung balance.

SUMMARY OF THE INVENTION

It is an object of the invention to overcome the various drawbacks of these known techniques.

More specifically, it is an object of the invention to provide a watch with a moon phase display providing a more realistic display of the phases of the moon.

It is another object of the invention to provide a moon phase mechanism that uses less energy and does not require actuation at a predetermined time.

It is also an object of the invention, at least in one specific embodiment, to provide a moon phase mechanism that is simple and inexpensive to implement.

These objects, in addition to others, which appear more clearly below, are achieved by the invention with the aid of a moon phase indicator mechanism, for a timepiece provided with a movement and a dial, the moon phase indicator mechanism comprising at least one moon disc, and at least one moon phase train disposed underneath the dial and driven by the timepiece movement, the moon phase train meshing with a moon phase wheel taking the form of a toothed ring in order to move the moon disc at the periphery of the dial about an axis A arranged at the centre of the dial, by means of the moon phase train.

According to the invention, the moon phase wheel carries, at least indirectly and in a fixed manner, the moon disc by means of an intermediate part, mounted on the toothed ring, the intermediate part surrounding the dial and the movement.

Thus, the subject of the present invention, through the different functional and structural aspects described above, provides a relatively compact moon phase mechanism that produces a more realistic moon phase indication.

In accordance with other advantageous variants of the invention:

- the intermediate part takes the form of a ring with a protruding peripheral rim on which the moon disc is secured;
- the toothed ring is provided with a toothing arranged on the inner rim of the ring comprising one hundred and seventy-five teeth;
- the moon phase display device comprises a single moon disc arranged to make one revolution of the dial in one lunar cycle;
- the timepiece movement further includes at least one hour wheel, the transmission ratio between the hour wheel and the moon phase wheel is equal to 0.5/29.53125;
- the moon phase display device including a device for correcting the position of the moon disc by acting on the moon phase train;
- the correction device comprises a correction crown, at least one corrector wheel set integral with the moon phase train, and a friction system arranged to detach all or part of the moon phase train from the movement when the position of the moon disc is corrected.

The invention also concerns a timepiece including a moon phase mechanism according to the invention.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1A:
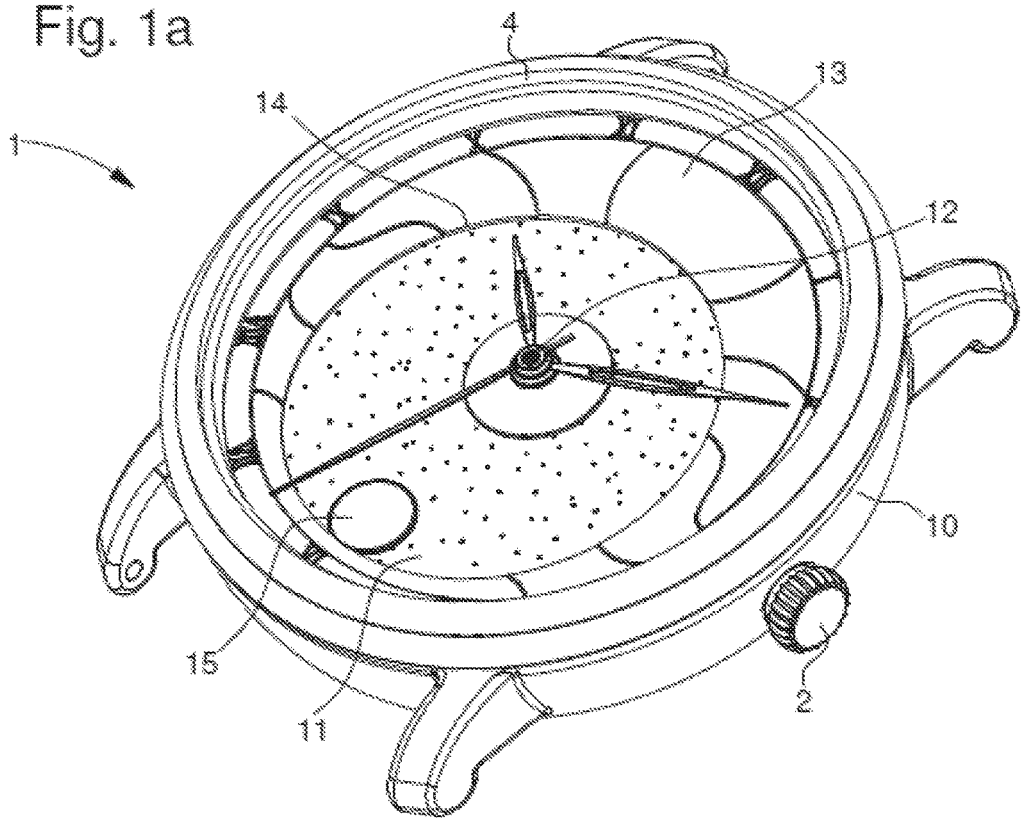
FIG. 1*a* is a perspective view of a watch equipped with a moon phase mechanism according to the invention.
Figure 1B:
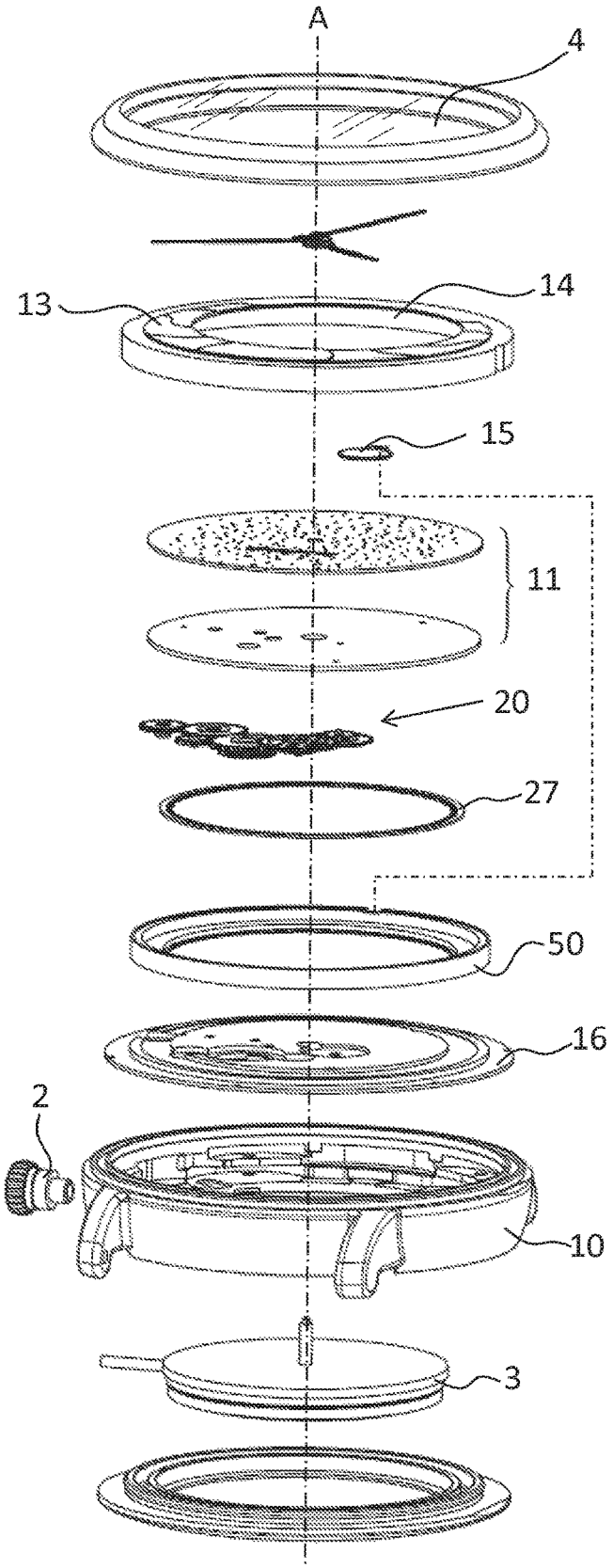
FIG. 1*b* is an exploded view of FIG. 1*a* of a watch equipped with a moon phase mechanism according to the invention.

A moon phase display device according to the invention will now be described below with reference jointly to FIGS. 1*a*, 1*b*, 2, 3, 4 and 5.

As illustrated in FIG. 1, watch 1 includes a case 10 forming a housing in which the movement 3 is mounted, the case being surmounted by a crystal 4 closing the front surface of case 10. The watch also includes an assembly forming dial 11 centred on axis A, and hands 12 cooperating with the dial to indicate the current time. The assembly forming dial 11 includes a decorative upper part visible to the person wearing the watch, and a lower part which is used for maintaining and guiding the arbors of the moon phase train.

The watch also includes a mask 13 of axis A, arranged above dial 11, mask 13 partly masking dial 11.

The watch is provided with a moon phase display device formed by an aperture 14 made in mask 13, and at least one moon disc 15, mounted to rotate between mask 13 and assembly 11. The at least one moon disc 15 is disposed on the outer diameter of dial 11, to make revolutions around dial 11 and so that moon disc 15 simulates a waxing moon when it appears in aperture 14 and a waning moon when it leaves aperture 14.

According to a first embodiment, mask 13 may be fixedly mounted and indicate, as required, the moon phases in the Northern Hemisphere or in the Southern Hemisphere.

Figure 5:
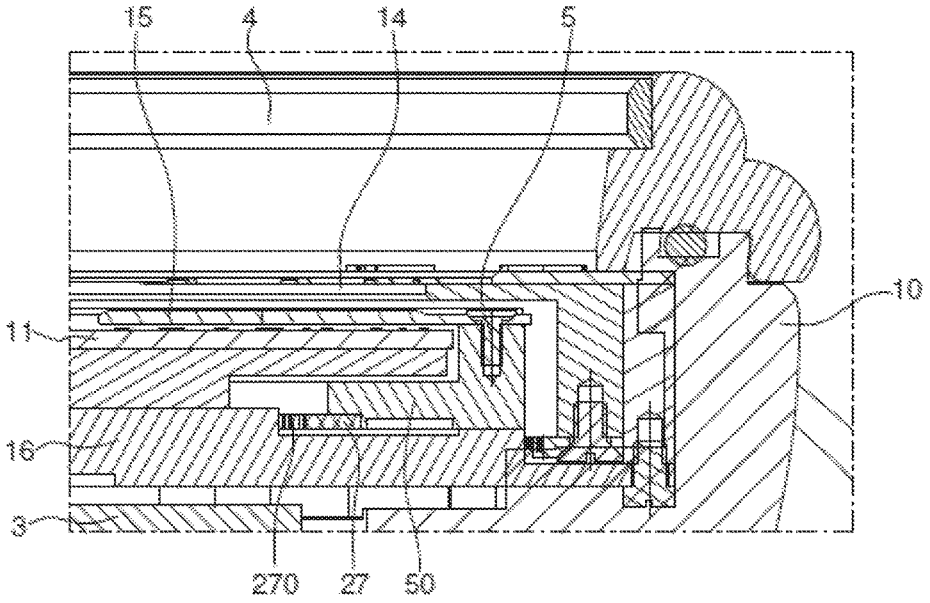
FIG. 5 is a partial sectional view of a watch equipped with a moon phase mechanism according to another embodiment.

According to another embodiment, visible in FIG. 5, mask 13 may be arranged to be movable and can then change from a first position in which moon disc 15 indicates the moon phases in the Northern Hemisphere, to a second position in which moon disc 15 indicates the moon phases in the Southern Hemisphere.

According to a particular feature of the invention, the moon phase mechanism comprises a single moon disc 15 which is arranged to make one revolution of the dial in one lunar cycle.

As shown, mask 13 is centred on axis A and has a circular aperture 14 which is off-centre relative to axis A.

As can be observed, the moon phase mechanism is mounted on the dial side of a plate 16 between plate 16 and the assembly forming dial 11.

Moon phase train 20 is driven by movement 3 of watch 1, and more specifically by an hour wheel, not visible in the Figures. Moon phase train 20 is arranged to mesh with a moon phase wheel which carries moon disc 15 at least indirectly and in a fixed manner.

According to the invention, the moon phase wheel is formed by a toothed ring 27 cooperating with moon phase train 20 in order to move moon disc 15 about axis A.

More specifically, moon phase train 20 is mounted on plate 16, and comprises a drive wheel 21 comprising sixty teeth and carrying a pinion 22 with twenty teeth, pinion 22 meshing with a wheel 23 with forty-five teeth carrying a pinion 24 with twenty teeth between strips 231 and 232. Pinion 24 meshes with a wheel 25 with forty-seven teeth meshing with a pinion 26 with twenty teeth cooperating with toothed ring 27 which has one hundred seventy-five teeth and receives moon disc 15. This arrangement allows moon disc 15 to make one revolution of the dial in 29.5306 days, which corresponds exactly to one lunar cycle.

Thus, the transmission ratio between the hour wheel and the moon phase wheel is equal to 0.5/29.53125. With such a moon phase train 20, the daily difference between the real moon and the moon of the mechanism is approximately fifty-six seconds, which corresponds to approximately a discrepancy of one day every one hundred and twenty-eight years, i.e. a relatively accurate mechanism.

According to a preferred embodiment of the invention, toothed ring 27 has a substantially identical diameter to that of the dial, centred on axis A, so as to move the moon at the periphery of dial 11. As can be observed in the Figures, toothed ring 27 is provided with a toothing 270 arranged on the inner rim of toothed ring 27. Of course, those skilled in the art have the knowledge required to reproduce a similar mechanism with a toothed ring 27 having a toothing on the outer rim.

As observed in FIG. 5, toothed ring 27 is mounted on an intermediate part 50 carrying moon disc 15, moon disc 15 may, for example, be screwed by means of a screw 5 onto the intermediate part. Advantageously, the intermediate part surrounds dial 11 and movement 3. Advantageously, intermediate part 50, seen in FIG. 1, takes the form of a ring with a protruding peripheral rim on which moon disc 15 is secured. Intermediate part 50 rests on plate 16 and may have rollers or any other means allowing intermediate part 50 to move in rotation while limiting friction on plate 16. The assembly composed of moon disc 15, intermediate part 50 and toothed ring 27 forms a one-piece element once assembled, this one-piece assembly being rotated around the dial relative to axis A by means of moon phase train 20.

It is also observed in FIG. 5 that watch 1 is provided with a mask 13 movable about axis A; mask 13 can be moved by drive means controlled by crown 2.

According to the invention, the moon phase indicator mechanism is provided with a device for correcting the position of the moon phase disc arranged to act on moon phase train 20. The correction device includes a correction crown 2 arranged to cooperate by meshing with at least one corrector wheel set integral with moon phase train 20, and a friction system arranged to detach all or part of moon phase train 20 from the movement when the moon disc position is corrected.

Figure 4:
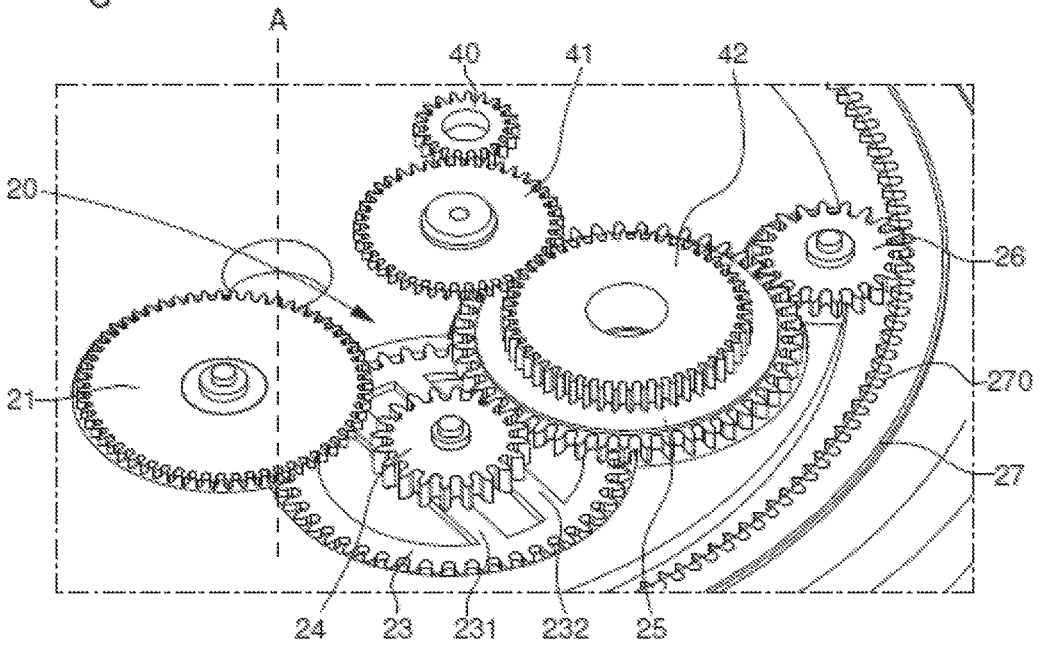
FIG. 4 is a detailed bottom view of a moon phase mechanism according to the invention.

As illustrated in FIG. 4, the correction device includes at least one corrector pinion 40 arranged to mesh at least indirectly with crown 2 when it is positioned in the correction position. Corrector pinion 40 meshes with a toothed correction wheel 41 meshing with an intermediate toothed wheel 42 integral with toothed wheel 25 of moon phase train 20.

Figure 2:
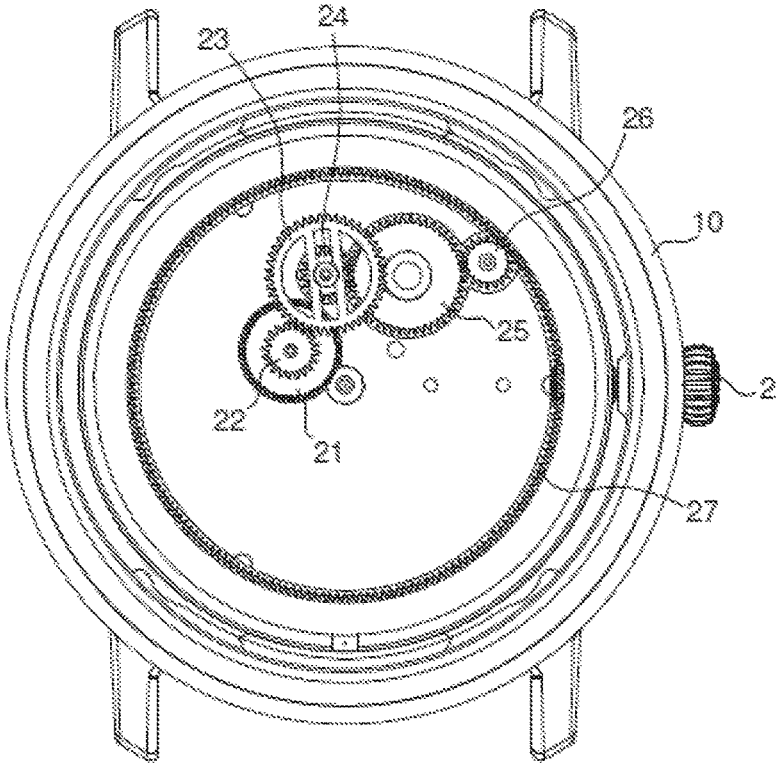
FIGS. 2 and 3 are respectively top and perspective views of a watch equipped with a moon phase mechanism according to the invention.
Figure 3:
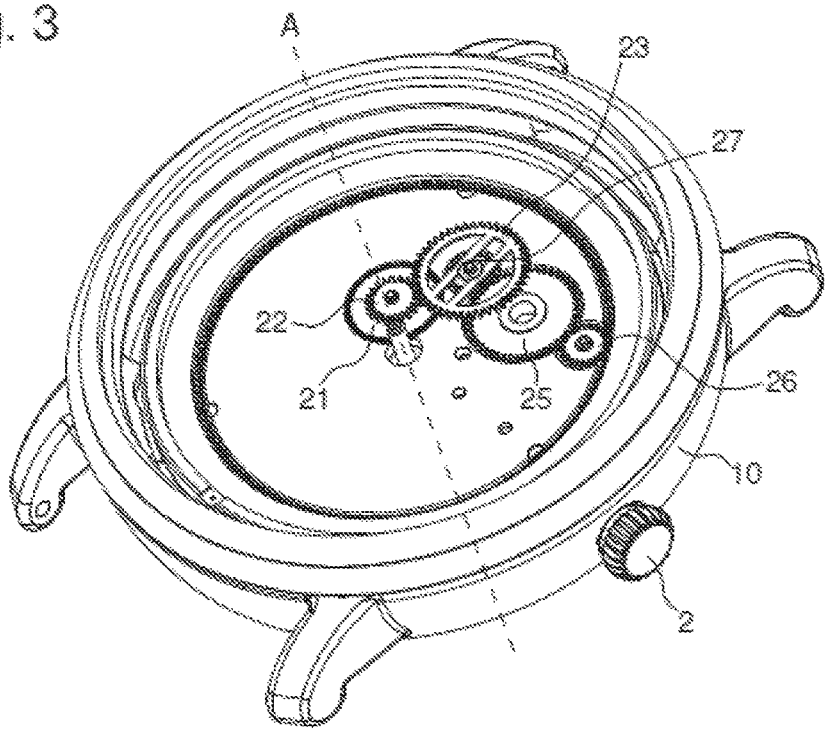

As observed in FIGS. 2 to 4, the friction system includes a friction wheel formed by toothed wheel 23 of moon phase train 20. When the correction wheel is engaged, pinion 24 carried by friction wheel 23 rotates between strips 231 and 232 without driving in rotation friction wheel 23.

The invention also concerns a timepiece equipped with a moon phase indicator mechanism according to the invention.

Of course, this invention is not limited to the illustrated example but is capable of different variants and modifications that will appear to those skilled in the art.

LIST OF PARTS

1. Watch
10. Case
11. Dial
12. Hands
13. Mask
14. Aperture
15. Moon disc
16. Plate
2. Crown
3. Movement
4. Crystal
5. Intermediate part
50. Screw,
20. Moon phase train
21. Drive wheel
22. Pinion
23. Friction wheel
231,232. Strips
24. Pinion
25. Wheel
26. Pinion
27. Toothed ring
270. Toothing
40. Correction pinion
41. Correction wheel
42. Intermediate wheel
A. Axis

The invention claimed is:

1. A moon phase indicator mechanism, for a timepiece provided with a movement and a dial, the moon phase indicator mechanism comprising:

at least one moon disc, at least one moon phase train disposed underneath the dial and driven by the timepiece movement, the moon phase train meshing with a moon phase wheel taking the form of a toothed ring in order to move the moon disc at a periphery of the dial about an axis A arranged at the centre of the dial, with the moon phase train, and an intermediate part, wherein movement of the moon disc around the dial is to simulate moon phases, and wherein the moon phase wheel indirectly carries the moon disc with the intermediate part such that the moon disc is non-rotationally fixed to the intermediate part, the intermediate part mounted on the toothed ring, the intermediate part surrounding the dial and the movement.

2. The moon phase indicator mechanism according to claim 1, wherein the intermediate part takes the form of a ring with a protruding peripheral rim on which the moon disc is secured.

3. The moon phase indicator mechanism according to claim 1, wherein the toothed ring is provided with a toothing arranged on the inner rim of the toothed ring comprising one hundred and seventy-five teeth.

4. The moon phase indicator mechanism according to claim 1, wherein the at least one moon disc is a single moon disc arranged to make one revolution of the dial in one lunar cycle.

5. The moon phase indicator mechanism according to claim 1, wherein the timepiece movement further includes at least one hour wheel, the transmission ratio between the hour wheel and the moon phase wheel is equal to 0.5/29.53125.

6. The moon phase indicator mechanism according to claim 1, including a device for correcting the position of the moon disc by acting on the moon phase train.

7. The moon phase indicator mechanism device according to claim 6, wherein the correction device comprises a correction crown, at least one corrector wheel set integral with the moon phase train, and a friction system arranged to detach all or part of the moon phase train from the movement when the position of the moon disc is corrected.

8. A timepiece comprising the moon phase indicator mechanism according to claim 1.

9. The moon phase indicator mechanism according to claim 1, wherein the moon disc is located inside the periphery of the dial.

10. A moon phase indicator mechanism, for a timepiece provided with a movement and a dial, the moon phase indicator mechanism comprising:

at least one moon disc;

at least one moon phase train disposed underneath the dial and driven by the timepiece movement, the moon phase train meshing with a moon phase wheel taking the form of a toothed ring in order to move the moon disc at a periphery of the dial about an axis A arranged at the centre of the dial, with the moon phase train; and an intermediate part taking the form of a ring with a protruding peripheral rim on which the moon disc is secured, wherein the moon phase wheel indirectly carries the moon disc with the intermediate part such that the moon disc is non-rotationally fixed to the intermediate part, the intermediate part mounted on the toothed ring, the intermediate part surrounding the dial and the movement.

11. The moon phase indicator mechanism according to claim 10, wherein the toothed ring is provided with a toothing arranged on the inner rim of the toothed ring comprising one hundred and seventy-five teeth.

12. The moon phase indicator mechanism according to claim 10, wherein the at least one moon disc is a single moon disc arranged to make one revolution of the dial in one lunar cycle.

13. The moon phase indicator mechanism according to claim 10, wherein the timepiece movement further includes at least one hour wheel, the transmission ratio between the hour wheel and the moon phase wheel is equal to 0.5/29.53125.

14. The moon phase indicator mechanism according to claim 10, including a device for correcting the position of the moon disc by acting on the moon phase train.

15. The moon phase indicator mechanism device according to claim 14, wherein the correction device comprises a correction crown, at least one corrector wheel set integral with the moon phase train, and a friction system arranged to detach all or part of the moon phase train from the movement when the position of the moon disc is corrected.

16. A timepiece comprising the moon phase indicator mechanism according to claim 10.

17. The moon phase indicator mechanism according to claim 10, wherein the moon disc is located inside the periphery of the dial.

* * * * *